US005299800A

United States Patent [19]

Daniels

[11] Patent Number: 5,299,800

[45] Date of Patent: Apr. 5, 1994

[54] BASKETBALL SHOT MAKING-SYSTEM

[76] Inventor: Mark T. Daniels, 2447 49th St., Sarasota, Fla. 34234

[21] Appl. No.: 81,113

[22] Filed: Jun. 25, 1993

[51] Int. Cl.[5] ..... A63B 63/08

[52] U.S. Cl. ..... 273/1.5 R

[58] Field of Search ..... 273/1.5 R, 1.5 A, 342

[56] References Cited

U.S. PATENT DOCUMENTS

| | | | |
|---|---|---|---|
| 263,161 | 2/1982 | Quinones | D21/201 |
| 2,889,149 | 6/1959 | Williams | 273/1.5 X |
| 3,910,575 | 10/1975 | Miller | 273/1.5 A |
| 4,036,494 | 7/1977 | Hayes | 273/1.5 R |
| 4,202,543 | 5/1980 | Collins | 273/1.5 X |
| 4,239,214 | 12/1980 | Brenner | 273/342 X |
| 4,372,555 | 2/1983 | Sorenson | 273/1.5 R |
| 4,424,968 | 1/1984 | Smith | 273/1.5 R |
| 4,468,027 | 8/1984 | Pangburn | 273/1.5 R |
| 4,478,415 | 10/1984 | Shaffer et al. | 273/1.5 R |
| 4,723,777 | 2/1988 | Jolly | 273/1.5 R |
| 4,826,162 | 5/1989 | Allen | 273/1.5 R |
| 4,834,369 | 5/1989 | Walsh | 273/1.5 R |
| 4,869,501 | 7/1989 | Anastasakis | 273/1.5 R |
| 4,895,365 | 1/1990 | Schroeder | 273/1.5 R |
| 4,946,163 | 8/1990 | Aakre et al. | 273/1.5 R |
| 4,951,944 | 8/1990 | Morgan | 273/1.5 R |
| 5,080,355 | 1/1992 | Offutt | 273/1.5 R |

*Primary Examiner*—Paul E. Shapiro
*Attorney, Agent, or Firm*—Franklin J. Cona

[57] ABSTRACT

A basketball shot-making system which can be used indoors or outdoors for increasing the number of possible installation locations and the number of methods of making a shot A backboard has paired members vertically disposed and in contact with each other along an edge forming a right angle inside corner. A goal having an arcuate hoop for shot-making is horizontally disposed and offset from the backboard. A goal support bracket is positioned therebetween and is in threadable communication with the backboard and in rigid communication with the goal. A rebound action device having a vertical orientation and being in threadable communication with the backboard is adjacent the inside corner right angle zone, the rebound action device further being in rigid communication with a top surface of the goal support bracket for increasing the number of shot-making possibilities. The basketball shot-making system can be installed in difficult locations such as indoor corners in older buildings not designed as gymnasium, or outdoors by using a base and support pole. The support pole has angular members in rigid communication with a non-playing surface of the backboard members for maintaining the backboard at the desired offset from the pole. The height of the system above the playing surface can be adjusted by a plurality of threadable collars in communication with the support pole to accommodate the conventional ten foot zero height (10'-0") as well as any height desired for children under 10 or physically challenged children or the like.

12 Claims, 5 Drawing Sheets

Fig. I
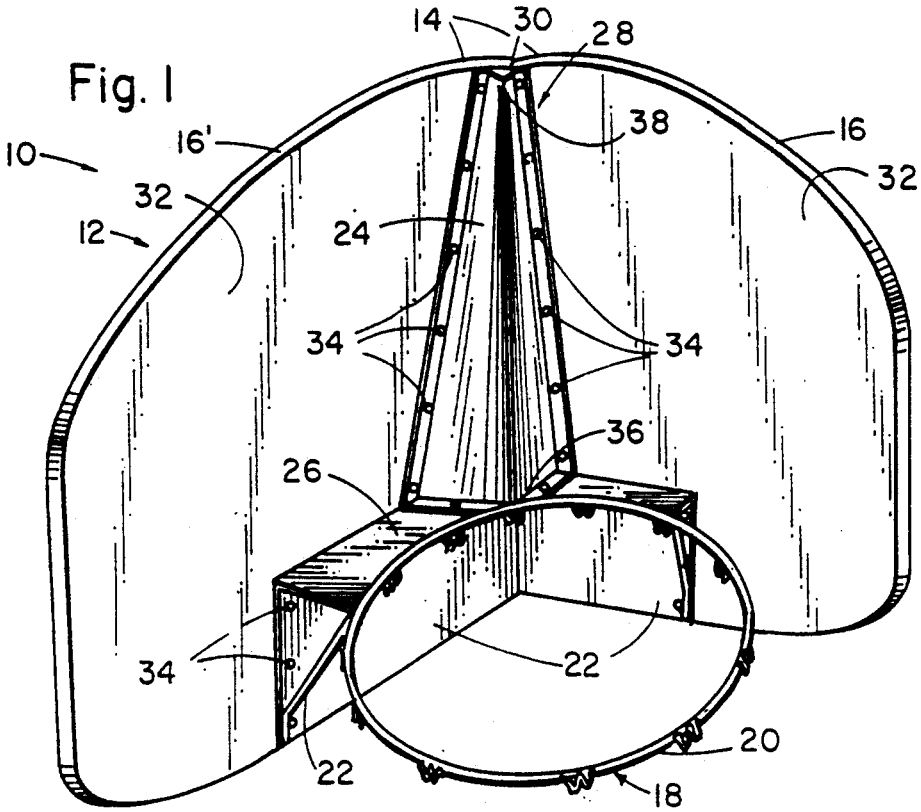
Fig. II
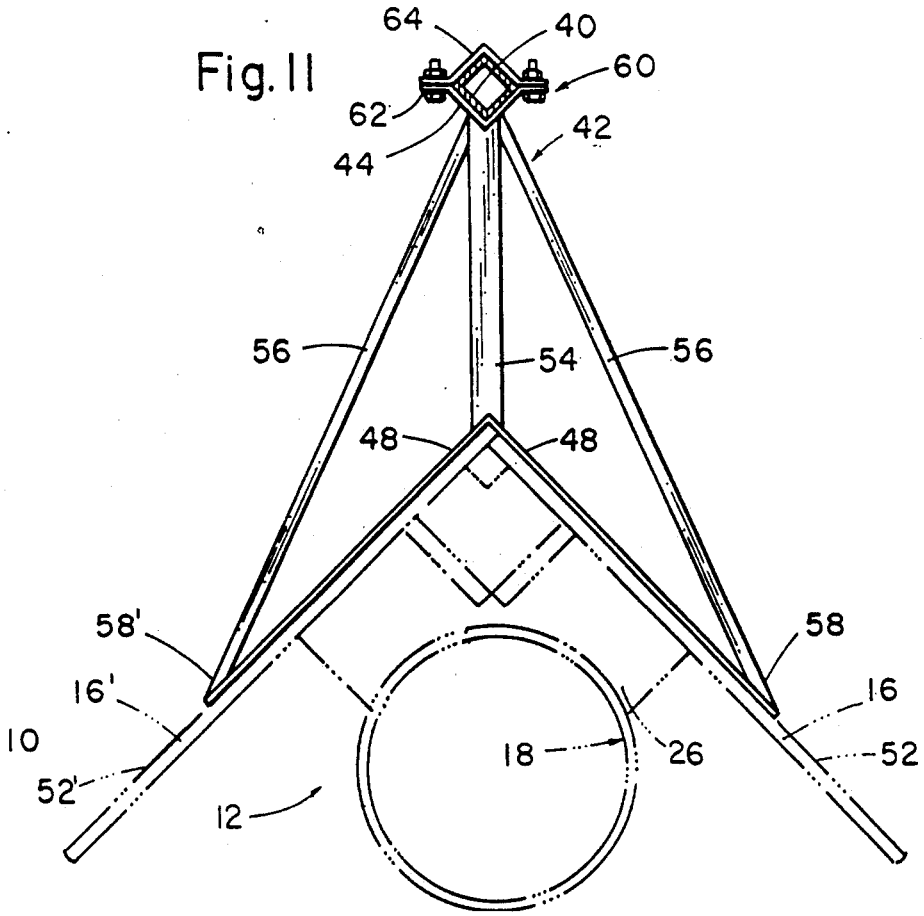

BASKETBALL SHOT MAKING-SYSTEM

BACKGROUND OF THE INVENTION

1. Field of the Invention

The present invention relates to a basketball shot-making system, and in particular, to a basketball shot-making system having right angled backboard members for installation in outdoor locations or in heretofore inaccessible inside corner locations, and a rebound action device in operative contact therewith to increase the number of possible shot-making combinations.

1. Description of the Background Art

Throughout the United States steps are being taken to improve the game of basketball and expand its popularity among the population. A typical current basketball hoop and backboard configuration comprises a flattened backboard surface, usually rectilinear or curvilinear shaped and a basketball hoop offset from the backboard in a horizontal disposition with a support bracket therebetween. However, the flattened surface of the backboard precludes the installation of the equipment in many indoor facilities, particularly in urban areas where buildings that were designed for other uses are being converted into community centers for youth activities. Further, the single backboard and hoop arrangement severely limits the number of possible shot-making combinations for the individual shooter.

Many attempts have been made to alter the configuration of the backboard and hoop for installations in outdoor locations and in difficult indoor locations and to increase the number of possible shot-making combinations in a basketball shooting game.

U.S. Pat. No. 5,080,355 issued to Offutt discloses a corner basketball backboard support bracket comprising a three-sided triangular support rim and a "J" shaped leg member.

U.S. Pat. No. 4,239,214 issued to Brenner discloses a basketball shot-making game with a different bank shot to make at a plurality of shooting stations.

U.S. Pat. No. 4,895,365 issued to Schroeder discloses a basketball pole mounting system for transmitting stresses directly to a backboard frame member.

U.S. Pat. No. 4,834,369 issued to Walsh discloses a basketball rim assembly for use with a sponge basketball. U.S. Pat. No. '369 also discloses a collapsible rim component of the assembly.

U.S. Pat. No. 4,826,162 issued to Allen discloses a basketball pole and backboard assembly designed to provide ninety-two percent of the usual backboard surface and still fit in a container to meet interstate commerce shipping regulations.

U.S. Pat. No. 4,723,777 issued to Jolley discloses a basketball goal and backboard assembly having an apparatus to absorb and dissipate energy received during dunkshots. U.S. Pat. No. '777 provides for the goal to return to its original operative position after the ball is passed through the goal during the dunkshot.

U.S. Pat. No. 4,424,968 issued to Smith discloses a basketball backboard assembly having a novel sandwich method of construction.

U.S. Pat. No. 4,372,555 issued to Sorensen discloses a backboard having built-in levelers to provide for adjustments to maintain the backboard in a vertical orientation so as not to affect the players during a game.

U.S. Pat. No. 4,869,501 issued to Anastasakis discloses a movable basketball pole having a base and a plurality of support members to support the goal in the deployed operative position.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore it is an object of this invention to provide a basketball shot-making system that will increase the number of potential installations both indoors and out-of-doors.

It is a further object of the invention to provide a basketball shot-making system that increases the number of shot-making possibilities by combining paired backboard members in a right angle configuration and a rebound action device in operative contact therewith.

It is a still further object of the invention to provide a basketball shot-making system with a rebound action device that has a shape that will not damage the basketball when the rebound action device is in bounceable communication with the basketball.

It is still further another object of the invention to provide a basketball shot-making system that can be fabricated from a variety of structural materials.

It is yet another still further object of the invention to provide a basketball shot-making system that has a vertical playing surface on the paired backboard members that can be produced in either a transparent or opaque finish.

It is a final object of the invention to provide a basketball shot-making system that can be readily adapted for outdoor use on a conventional base and pole, currently used for the conventional backboard and goal assemblies.

A final object of this invention to be specifically enumerated herein is to provide a basketball shot-making system in accordance with the preceding objects and which will conform to conventional forms of manufacture, be of simple construction and easy to use so as to provide a device that would be economically feasible, long lasting and relatively trouble free in operation.

Although there have been many inventions related to basketball shot-making systems, none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a basketball shot-making system for increasing the number of possible locations for installation and for increasing the number of possible methods of making a goal. This system can be used either indoors or outdoors. The system comprises a backboard having paired members vertically disposed and oriented at a right angle with respect to each other forming an inside corner and in threadable communication along an outer edge. A goal having an arcuate hoop for receiving the basketball is horizontally disposed and offset from the backboard, and a goal support bracket therebetween is in threadable communication with the paired backboard members and in rigid communication with the goal. A rebound action device having a vertical disposition is in threadable communication with each member of the backboard adjacent the inside corner formed where the respective outer edges are in threadable communication. The rebound action device is also in rigid communication with a top surface of the support bracket. The rebound action device has a longitudinal bisected pyramid shape for dramatically increasing the number of possible shot-making paths. Further, the rebound action device has an outside corner bead with an outer periphery having an arcuate shape for eliminating any possibility of damage to the basketball when bounceable communication occurs. The system is installable in indoor locations in many inside corners where heretofore basketball goals of the conventional type could not be installed. Further, the system can be installed with a conventional base and support pole for use in out-of-door playgrounds and the like. An adjustment means is provided to alter the height of the goal to any appropriate height to suit the age of the shooter or the physical development of the shooter. The backboard members can be fabricated from any suitable flat structural material, for example, plywood or fiberglass or a composite material, but preferably fiberglass. The backboard members can be produced with either a clear or an opaque finish, based on the desires of the shooter, but preferably a clear finish. The hoop is fabricated from a metal, preferably carbon steel and is similar in size to conventional basketball hoops. The hoop support bracket is also fabricated from a metal, preferably carbon steel. The rebound action device can be fabricated from any structural material such as fiberglass or metal, preferably carbon steel.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective of the invention showing the paired backboard members, the support bracket and the hoop, and the rebound action device positioned on a top surface of the support bracket adjacent the right angle formed by the paired backboard members.

FIG. 2 also shows the rebound action device positioned on a top surface of the support bracket and further shows the truncated apex of the rebound action device.

FIG. 4 also shows the outside corner bead forming the angular portion of the bisected pyramid.

FIG. 9 shows the sleeve in a generally vertical orientation, and the lower offset rod angularly disposed, having a first end attached to the sleeve and a second end attached to the horizontal bar.

FIG. 11 is a top plan view of the sleeve and offset frame apparatus showing the plurality of anti-sway bars having a first end being attached to the sleeve and having a second end attached to the horizontal bar, and the horizontally disposed upper offset rod having a first end attached to the sleeve and a second end attached to the horizontal bar.

Similar reference characters refer to similar parts throughout the several views of the drawings.

DETAILED DESCRIPTION OF THE PREFERRED EMBODIMENT

Figure 3:
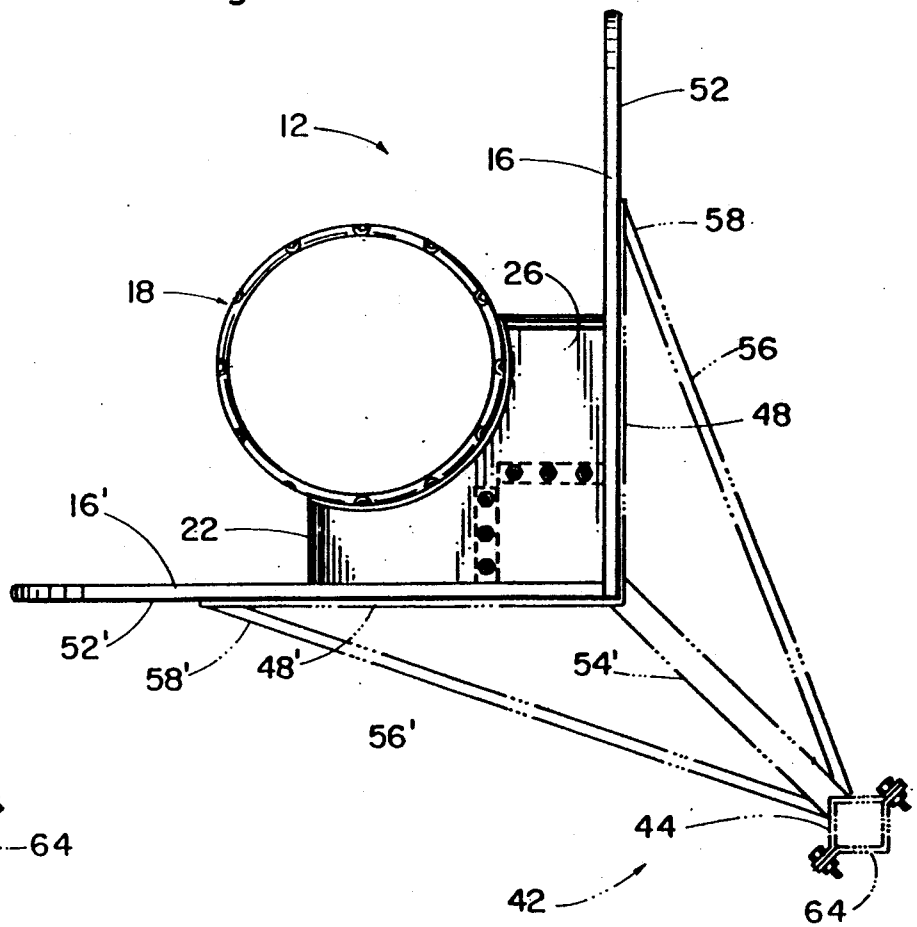
FIG. 3 is a bottom plan view of the invention showing the underside of the support bracket and the goal.

Referring to FIG. 1, the invention 10 comprises a basketball shot-making system 12 having a backboard 14 having paired members 16,16' vertically disposed, a regulation sized basketball goal 18 in the shape of a basketball hoop 20, a support bracket 22 connecting the goal 18 and the paired members 16,16' of the backboard 14, and a rebound action device 24 mounted on an upper surface 26 of the support bracket 22 and attached to the paired backboard members 16,16'.

Figure 2:
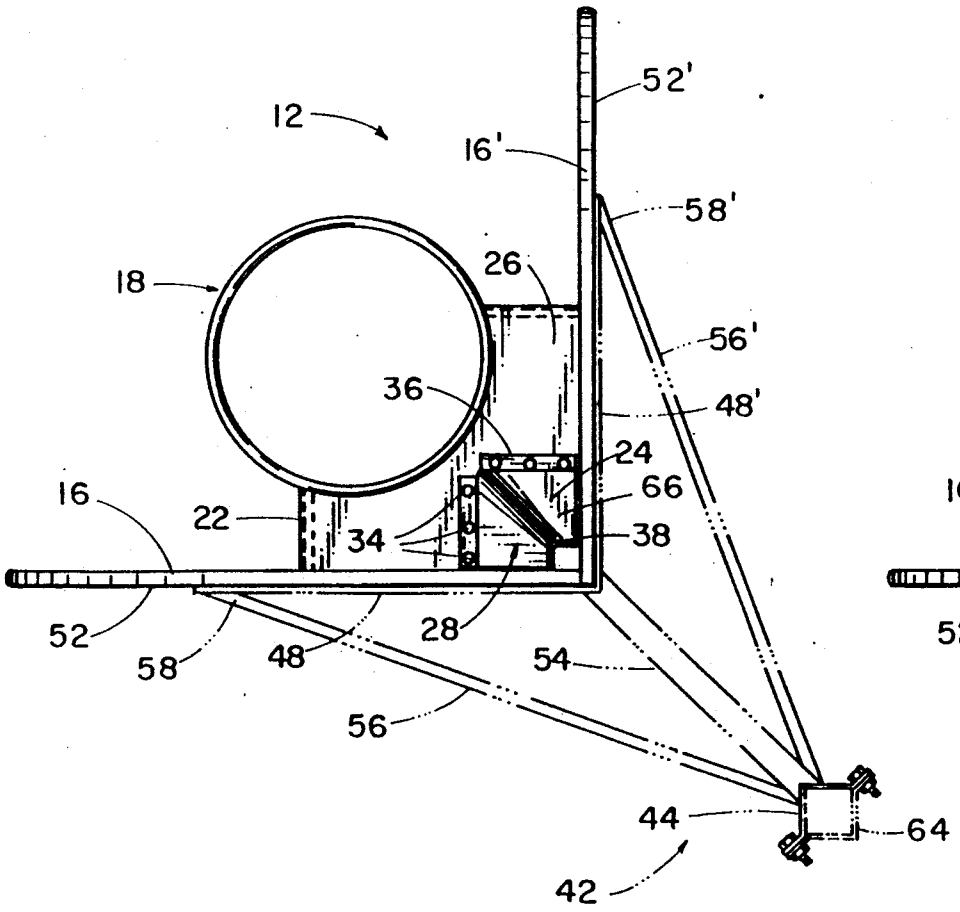
FIG. 2 is a top plan view of the invention showing the goal being offset from the paired backboard members and rigidly attached connected to the support bracket.

The paired backboard members 16,16' are disposed at right angles to each other for forming an inside corner zone 28, and the backboard member 16 is fastened to the other backboard member 16' along an edge 30, as best seen in FIG. 2. The basketball goal 18 is disposed horizontally and is offset from a vertical playing face 32 of each backboard member 16,16'. The support bracket 22 is rigidly attached to the goal 18 and threadably attached to the vertical playing face 32 of each backboard member 16,16' with a plurality of fasteners 34.

The rebound action device 24 is mounted on the upper surface 26 of the support bracket 22 and threadably attached to the vertical playing face 32 of each backboard member 16,16' with a plurality of fasteners 34. The rebound action device 24 can be configured in a variety of geometric shapes for increasing the variety of shot-making possibilities in the system 12. Many geometric shapes will work such as a right angle box, a longitudinal angular cone, and a plurality of nested contiguous tubes, but the preferred shape is a longitudinal bisected pyramid with the top of the pyramid being truncated, as best seen in FIG. 2. The rebound action device 24 is positioned on the upper surface 26 of the support bracket 22 in the inside corner zone 28 formed by the right angle relationship of the respective edges 30,30' of the paired backboard members 16,16' being in contact with each other. A base 36 of the rebound action device 24 has a greater area than an area of an apex 38 of the rebound action device 24, as best seen in FIG. 2.

The major advantage of the basketball shot-making system 12 over conventional basketball backboards and goals are two-fold.

First, the right angled backboard members 16,16' dramatically increase the number of installable locations, particularly indoors in heretofore unused ninety degree inside corners. Older buildings that are converted to youth activities in urban areas can use the basketball shot-making system 12 in locations that are not feasible for conventional basketball backboard and goal combinations. Outside usage is also increased. The system 12 can be installed alongside a driveway or alleyway where a conventional backboard could not be used due to the support system having to be in the middle of the playing area.

Second, the combination of the paired backboard members 16,16' having a right angle relationship and the rebound action device 24 being adjacent the inside corner zone 28 dramatically increases the number of shot-making combinations possible. For example, the shooter could aim for a combination bank shot using each of the paired backboard members 16,16' only, or only one of the backboard members 16. Also, the shooter could aim for a combination bank shot using only one of the paired backboard members 16' and the rebound action device 24, or the rebound action device 24 alone, or any one of the number of combinations of the backboard members 16,16' and the rebound action device 24, depending on the shooter's position relative to the system 12, and the skill level of the shooter. It should be understood that although the system 12 is intended for use with the goal 18 being positioned at ten foot zero inches (10'-0") above the playing surface where the shooter is stationed, the system 12 can be installed at a different height above the playing surface to accommodate smaller shooters such as children under 10 years old, or the like.

Figure 7:
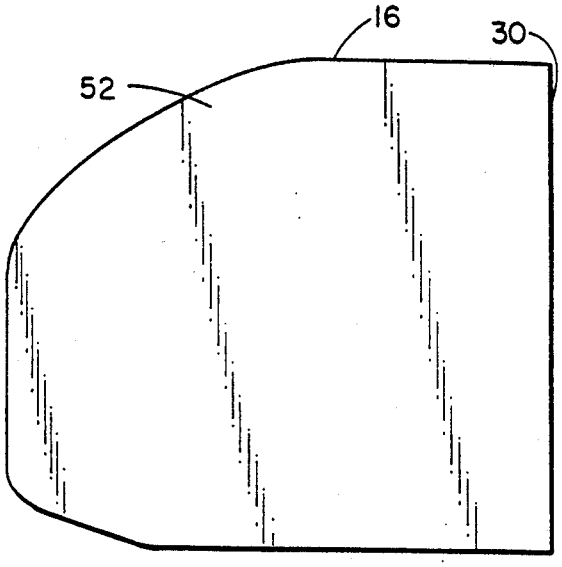
FIG. 7 is a rear side elevational view of the right hand backboard member showing the non-playing surface.
Figure 6:
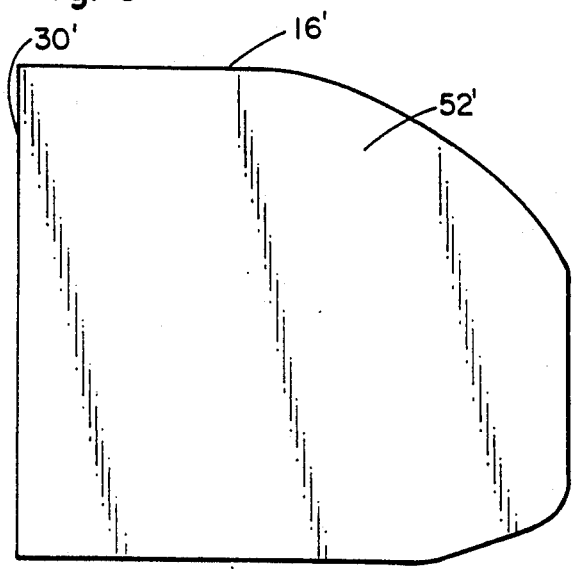
FIG. 6 is a rear side elevational view of the left hand backboard member showing the non-playing surface.
Figure 8:
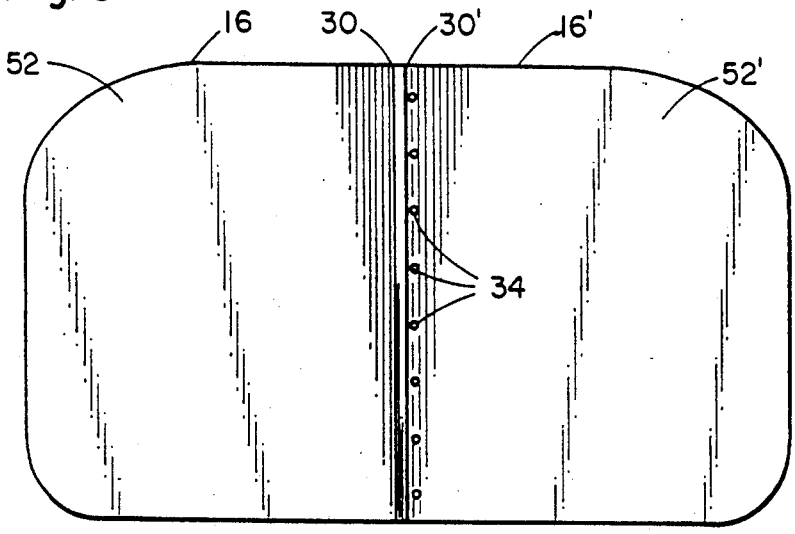
FIG. 8 is a rear elevational view showing the paired backboard members being in threadable communication along the edge forming the right angle.
Figure 9:
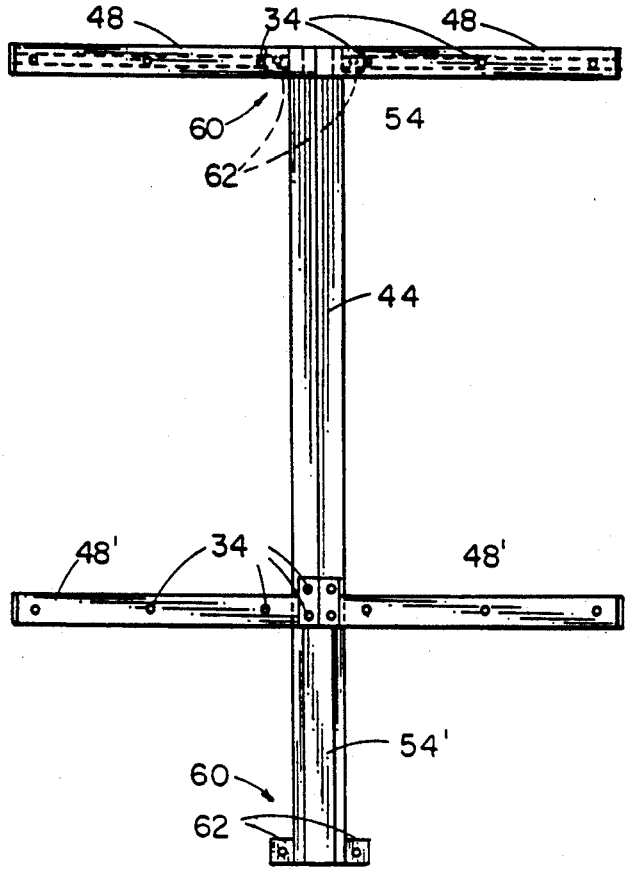
FIG. 9 is a front elevational view of the sleeve and offset frame for use with the invention in an out-of-doors location.
Figure 10:
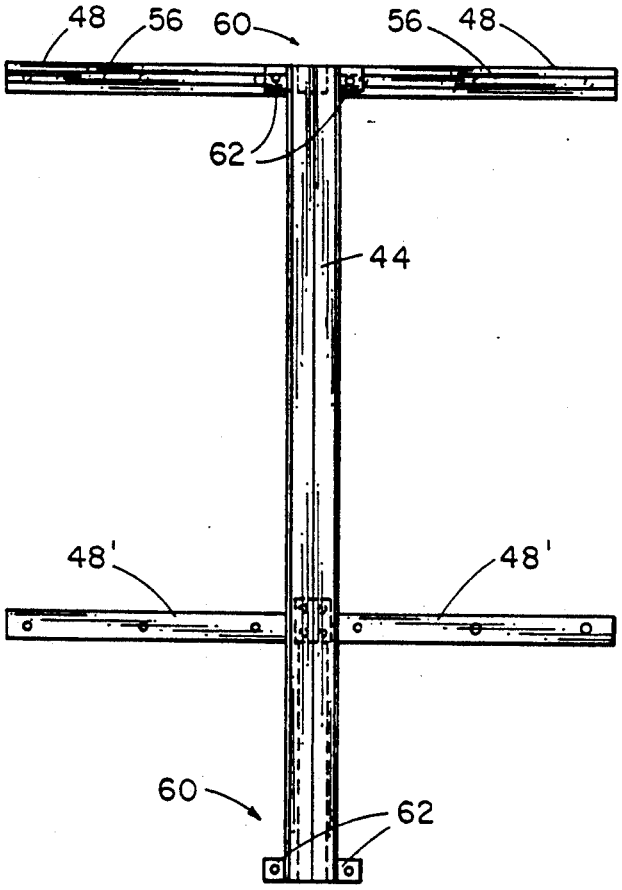
FIG. 10 is a rear elevational view of the sleeve and offset frame for use in out-of-door locations.

The backboard member 14 is attached to a support pole 40 with an offset frame 42 for use out-of-doors, as best seen in FIG. 7. The offset frame 42 has a sleeve 44 in adjustable communication with the support pole 40 to allow the height of the goal 18 to be set at any desired elevation. The support pole 40 has a lower end 46 adapted to be secured to a non-illustrated base. The base can be recessed in the ground for permanent installation out-of-doors or can be moveable for portable installations indoors or out-of-doors as in driveways or playgrounds or the like. The base is sufficiently sized and weighted to remain stable when the shooter touches the goal 18 as in a dunk shot. A plurality of horizontal bars 48,48' on a distal end 50 of the offset frame 42 are fastened to a non-playing vertical face 52,52' of each backboard member 16,16'. The horizontal bars 48 are attached to the non-playing vertical face 48,48' with threaded fasteners 34. The offset frame 42 has paired offset rods 54,54' in rigid communication with the sleeve 44 and the horizontal bars 48 to maintain the backboard member 14 at the desired offset from the support pole 40. A plurality of anti-sway bars 56,56' are rigidly attached and horizontally disposed from the sleeve 44 and in rigid communication with an outer end 58,58' of the horizontal bar 48 to prevent rotational movement of the backboard member 14 when the basketball hits the paired backboard members 16,16'.

As best seen in FIG. 11, an adjustment means 60 has a plurality of threadable adjustable collars 62 and adjustable brackets 64 circumadjacent the sleeve 44 for adjusting the height of the goal 18 to any desired level, depending on the size of the shooter. For example, in an out-of-doors playground summer league basketball program, the height of the goal 18 could be set at a different level for each age group that would challenge the shooter according to age level or, their physical development as in programs for the physically challenged.

Figure 5:
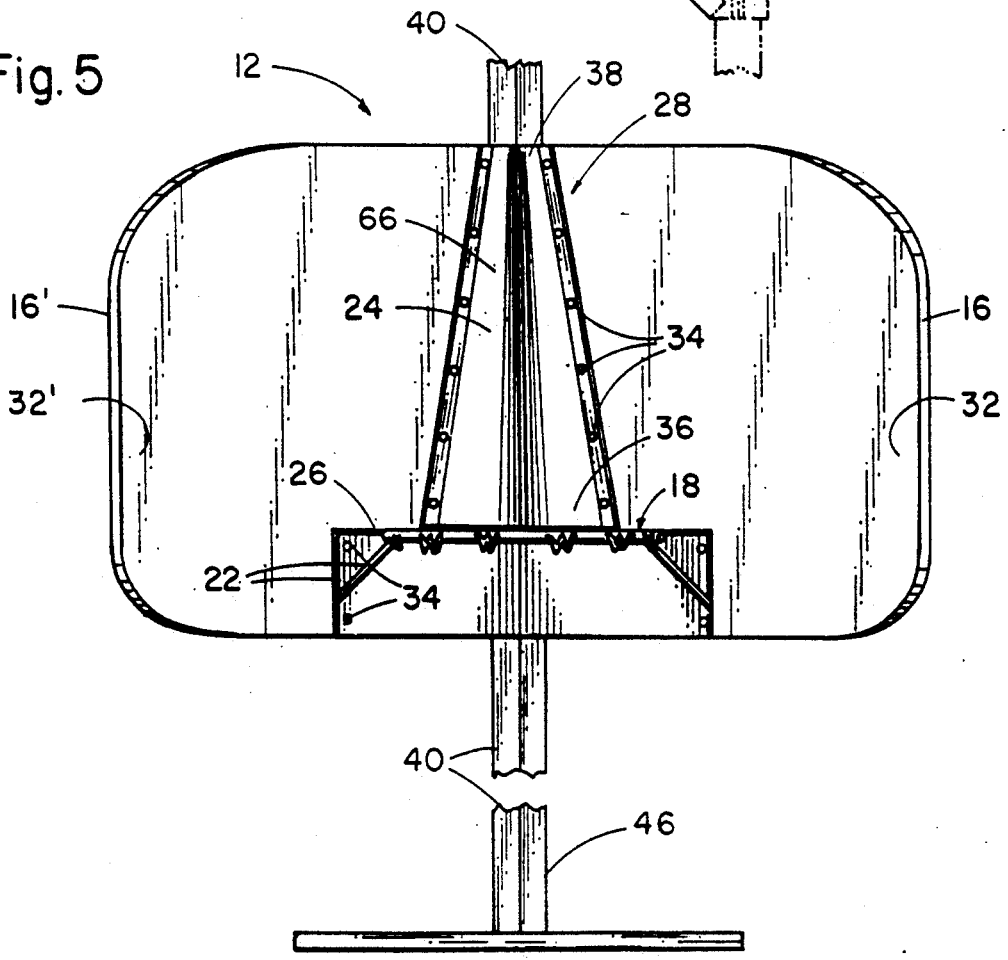
FIG. 5 is a front elevational view of the invention showing the rebound action device in operative contact with the support bracket and the paired backboard members being in a ninety degree relationship.

The rebound action device 24 forms a longitudinal bisected angular pyramid 66, as best seen in FIG. 5. The rebound action device 24 has an outside corner bead 68 that has an arcuate shape for allowing the basketball to contact the outside corner bead 68 without damage to the basketball as best seen in FIG. 2. Also, the arcuate shape increases the number of possible rebound return paths when the basketball contacts the outside corner bead 68.

Figure 4:
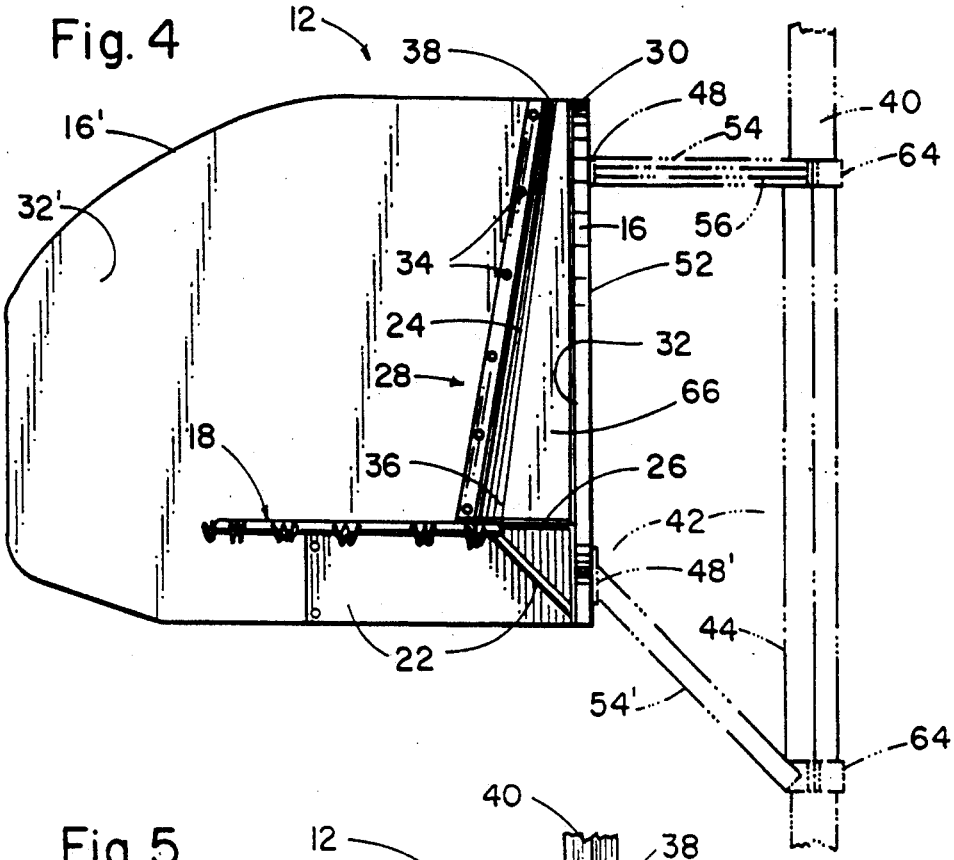
FIG. 4 is a right hand edge elevational view showing a paired backboard member in full frontal elevation and the second paired backboard member in an elevational edge view.

The paired backboard members 16,16' can be fabricated from any number of structural durable material, for example fiberglass or plywood, or a composite material, but preferably fiberglass. The paired backboard members 16,16' can be rectilinear or curvilinear in shape, preferably curvilinear as best seen in FIGS. 4 and 5. The paired backboard members 16,16' can be produced with a clear or opaque vertical playing surface 32, preferably a clear surface.

The rebound action device 24 can be fabricated from any sturdy structural material such as fiberglass or metal, preferably carbon steel.

The offset frame 42 can be fabricated from any sturdy structural material such as aluminium or steel, preferably carbon steel.

The non-illustrated base can be fabricated from any sturdy structural construction material such as concrete for permanent installations or from fiberglass or aluminum for portable installations, preferably fiberglass.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A basketball shot-making system for increasing the number of possible locations for installation and for increasing the number of methods of making a shot for use indoors or outdoors comprising in combination;

A backboard having paired members vertically disposed, each member being at a right angle with respect to the other member for forming an inside corner each member further having an edge being in threadable communication with an edge of the other member;

A goal having an arcuate hoop for urging shot-making and being horizontally disposed and offset from the backboard;

A goal support bracket therebetween being horizontally disposed and being in threadable communication with the backboard and rigid communication with the goal;

A rebound action device having a vertical orientation and being in threadable communication with each member of the backboard adjacent the inside corner, the rebound action device further being in rigid communication with a top surface of the goal support bracket for increasing the number of shot-making possibilities;

A vertically disposed support pole and an offset frame, the offset frame having a sleeve adjacent the vertical support pole, a pularity of horizontal bars being in rigid communication with a rear non-playing surface of the backboard, and paired offset rods therebetween for maintaining the backboard at a desired offset from the support pole ;

A base adapted to receive a lower end of the support pole for urging the support pole to remain stable and immovable when the system is in use and operation as in a dunk shot or the like; and Adjustment means to move the backboard up and down the support pole for changing the elevation of the goal for urging variations in the shot-making system.

2. A basketball shot-making system as recited in claim 1 wherein the rebound action device further includes a base being in rigid communication with the top surface of the support bracket, a top having a smaller cross sectional area than the base, and an outside corner bead therebetween for forming a longitudinal bisected pyramid for urging bounceable communication with the basketball and for increasing the number of methods of making a shot.

3. A basketball shot-making as recited in claim 2 wherein the rebound action device is fabricated from a metallic construction material.

4. A basketball shot-making system as recited in claim 2 wherein the rebound action device is fabricated from a non-metallic structural material.

5. A basketball shot-making system as recited in claim 1 wherein the backboard is displaceable on the support pole for changing the height of the goal to accommodate bigger people and smaller people.

6. A basketball shot-making system as recited in claim 1 wherein the backboard is fabricated from an opaque, flat structural material.

7. A basketball shot-making system as recited in claim 1 wherein the backboard is fabricated from a transparent, flat structural material.

8. A basketball shot-making system as recited in claim 1 wherein the rebound action device has a longitudinal bisected pyramid shape.

9. A basketball shot-making system as recited in claim 1 wherein the offset frame further includes a plurality of anti-sway bars, each anti-sway bar having a first end rigidly attached to the sleeve and a second end rigidly attached to the horizontal bar on the rear non-playing surface of the backboard for maintaining a stable orientation when the ball is in bouncable communication with the backboard.

10. A basketball shot-making system as recited in claim 1 wherein the outside corner bead further includes an arcuate shaped outer surface for increasing the number of possible rebound paths when the basketball is in bounceable communication with the outside corner bead.

11. A basketball shot-making system as recited in claim 1 wherein the adjustment means further includes a plurality of adjustable collars and a plurality of adjustable brackets, each collar and each bracket being in compressive communication with the sleeve by means of fasteners for maintaining the backboard at a desired height.

12. An apparatus for increasing the number of possible locations for installation and for increasing the number of methods of making a shot in a basketball shot-making game comprising a backboard having paired members vertically disposed, each member being at a right angle with respect to the other member for forming an inside corner, and each member further having an edge being in threadable communication with an edge of the other member, a goal having an arcuate hoop for urging shot-making and being horizontally disposed and offset from the backboard, a goal support bracket therebetween being horizontally disposed and being in threadable communication with the backboard and rigid communication with the goal, and a rebound action device having a longitudinally bisected pyramid shape and further having a vertical orientation and being in threadable communication with each member of the backboard adjacent the inside corner, the rebound action device further being in rigid communication with a top surface of the goal support bracket for increasing the variety of shot-making possibilities.

* * * * *